US008720764B2

(12) United States Patent
Ploss

(10) Patent No.: US 8,720,764 B2
(45) Date of Patent: May 13, 2014

(54) FUEL CELL ADAPTER

(75) Inventor: Peter D. Ploss, Grayslake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 484 days.

(21) Appl. No.: 13/173,867

(22) Filed: Jun. 30, 2011

(65) Prior Publication Data

US 2013/0004863 A1 Jan. 3, 2013

(51) Int. Cl.
*B25C 7/00* (2006.01)

(52) U.S. Cl.
USPC ..... 227/10; 227/156

(58) Field of Classification Search
USPC ..... 227/9, 10, 130, 156
See application file for complete search history.

(56) References Cited

U.S. PATENT DOCUMENTS

| | | | | |
|---|---|---|---|---|
| 3,990,919 | A * | 11/1976 | Krueger | 429/100 |
| 3,998,516 | A * | 12/1976 | Mabuchi | 439/500 |
| 4,403,722 | A | 9/1983 | Nikolich | |
| 4,483,474 | A | 11/1984 | Nikolich | |
| 4,522,162 | A | 6/1985 | Nikolich | |
| 5,115,944 | A | 5/1992 | Nikolich | |
| 5,971,245 | A | 10/1999 | Robinson | |
| 6,796,478 | B2 * | 9/2004 | Shkolnikov et al. | 227/10 |
| 7,478,740 | B2 * | 1/2009 | Shea et al. | 227/10 |
| 7,571,841 | B2 * | 8/2009 | Gibson et al. | 227/10 |
| 7,841,500 | B2 * | 11/2010 | Ho | 227/10 |
| 2003/0111135 | A1 | 6/2003 | Vallon et al. | |
| 2010/0224666 | A1 | 9/2010 | Miyata | |
| 2010/0294798 | A1 | 11/2010 | Dreveton et al. | |

* cited by examiner

*Primary Examiner* — Andrew M Tecco
(74) *Attorney, Agent, or Firm* — Greer, Burns & Crain, Ltd.; Maurice E. Finnegan, III; Mark W. Croll

(57) ABSTRACT

A fuel cell adapter to be received in a combustion tool fuel cell cavity, the cavity having a predetermined diameter, and the adapter having a post extending longitudinally along an axis. First and second platforms are positioned at a first and second end of the post and they extend laterally outwardly from the post to occupy a distance slightly less than the predetermined diameter of the fuel cell cavity. A flange extends from the post between the first and second ends of the post and has at least one portion extending laterally outwardly from the post to occupy a distance, when combined with the post, slightly greater than the predetermined diameter of the fuel cell cavity. The flange is formed of a resilient material and a thickness so as to permit the flange to be deformed as the adapter is inserted into the fuel cell cavity.

14 Claims, 3 Drawing Sheets

FUEL CELL ADAPTER

BACKGROUND OF THE INVENTION

This invention relates generally to an adapter for use with a fuel cell in a combustion tool, and more specifically to an adapter for use in allowing a shorter or smaller fuel cell to be used in a tool designed for accepting a longer or larger fuel cell.

As exemplified in Nikolich U.S. Pat. Nos. 4,403,722; 4,483,474; 4,522,162; and 5,115,944, all of which are incorporated by reference, it is known to use a dispenser such as a fuel cell to dispense a hydrocarbon fuel to a combustion tool, also known as a combustion gas-powered tool, such as, for example, a combustion gas-powered fastener-driving tool, also known as a combustion nailer. Such fastener-driving tools and fuel cells are available commercially from ITW-Paslode (a division of Illinois Tool Works, Inc.) of Vernon Hills, Ill., under its IMPULSE trademark.

In some combustion tools, there is a cavity provided in the tool for receiving a fuel cell of a specific length so that the outlet of the fuel cell will engage properly with a dispensing outlet to deliver a proper amount of gaseous fuel to a combustion chamber for powering the tool. Fuel cells are therefore produced with a specific length and size to be accommodated in this cavity to properly position the fuel cell outlet relative to the dispensing outlet of the tool.

For various reasons, it has become necessary or desirable to provide fuel cells having a shorter length or smaller size for various tools, resulting in multiple sizes of fuel cells being manufactured, each being able to be used only in a tool designed to accommodate one of the particular sizes of the fuel cells. Therefore, it would be an improvement if an adapter were available to allow a tool manufactured for using a longer fuel cell to be able to accommodate and use a shorter fuel cell.

SUMMARY OF THE INVENTION

The present invention provides an adapter which can be inserted into a fuel cell cavity of a combustion tool to properly position a shorter fuel cell into the cavity so that the shorter fuel cell is positioned properly relative to the outlet and so that it is held in a stable condition.

In an embodiment, the adapter for a fuel cell includes a first and second platform positioned at a first and second end of a post. Each platform has at least one portion extending laterally outwardly from the post to occupy a distance slightly less than the predetermined diameter of the fuel cell cavity. A flange extends from the post between the first and second ends of the post and has at least one portion extending laterally outwardly from the post to occupy a distance, when combined with the post, slightly greater than the predetermined diameter of the fuel cell cavity. The flange is formed of a resilient material and a thickness so as to permit the flange to be deformed as the adapter is inserted into the fuel cell cavity.

In an embodiment, the post is located along a central axis and the first and second platforms and the flange extend radially outwardly from the post in at least two radial directions.

In an embodiment, the first and second platforms are circular disks, each with a center point centered at the axis of the post and having a diameter slightly smaller than the predetermined diameter of the fuel cell cavity.

In an embodiment, the flange is a circular disk having a diameter slightly larger than the predetermined diameter of the fuel cell cavity.

In an embodiment, the flange has a tapering thickness towards an outer periphery of the circular disk.

In an embodiment, the post comprises a lateral cross section having a plurality of outwardly extending lobes.

In an embodiment, the adapter is made of molded polypropylene.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DETAILED DESCRIPTION OF THE PREFERRED EMBODIMENTS

Figure 1:
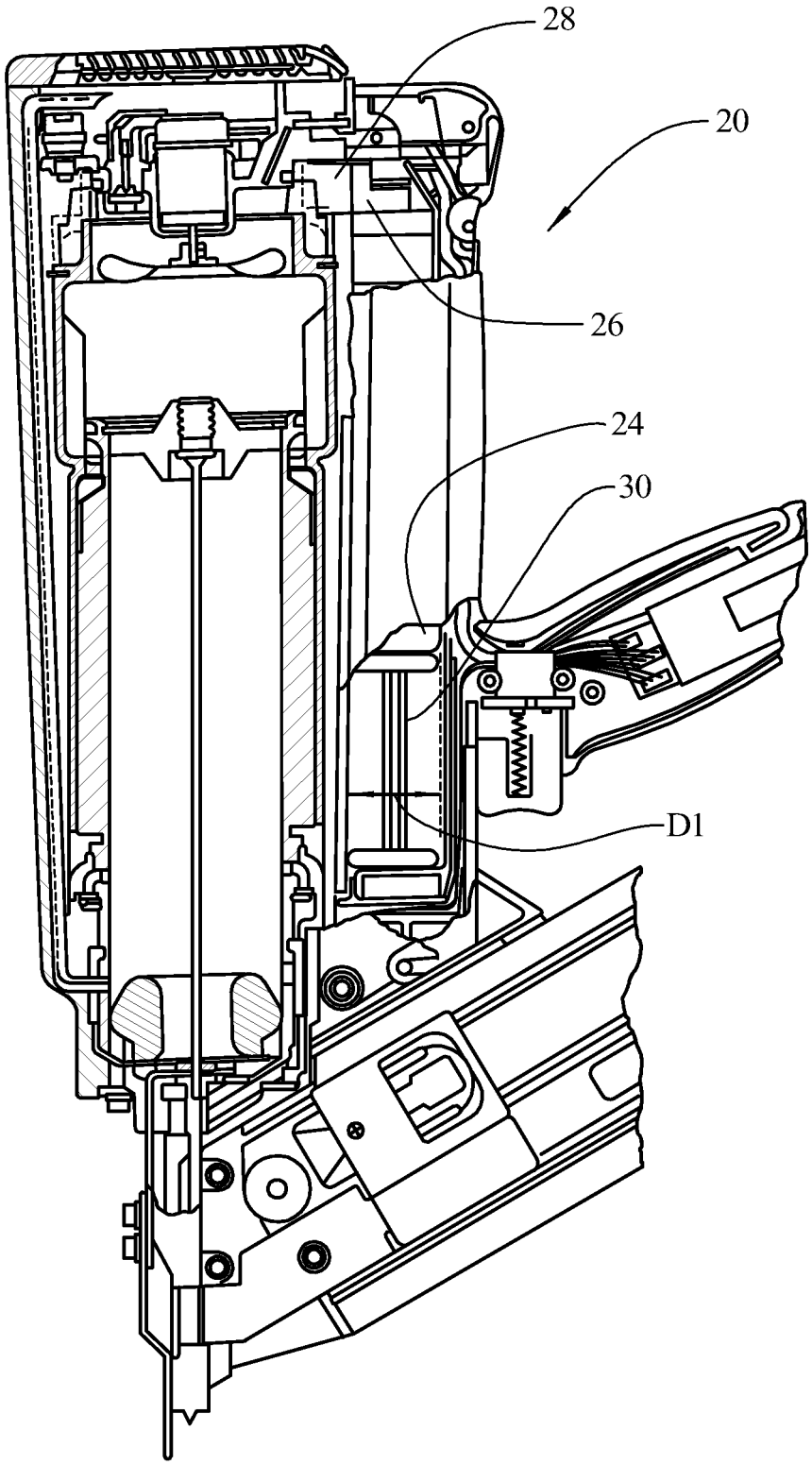
FIG. 1 is side sectional view of a combustion tool having a fuel cell cavity occupied by a short fuel cell and an adapter embodying the principles of the present invention.

Referring now to FIG. 1, a combustion tool 20 is illustrated which has a cavity 22 for receiving a fuel cell 24 which powers the combustion tool. The fuel cell cavity 22 is designed to have a length which will accommodate a standardized sized fuel cell, so that an outlet 26 of the fuel cell will be positioned correctly relative to a dispensing outlet 28 in the tool 20. The cavity 22 has a predetermined narrow lateral dimension D1 which accommodates the diameter of the fuel cell 24. Although the fuel cell cavity 22 need not be cylindrical, the predetermined narrow lateral dimension D1 will be referred to herein as the predetermined diameter D1. What is meant by this term is the narrowest lateral dimension of the fuel cell cavity. The present invention provides an adapter 30 which allows a shorter or smaller fuel cell 24 to be used in the tool 20 instead of the normal or largest size of the fuel cell that can be accommodated in the cavity.

Figure 2:
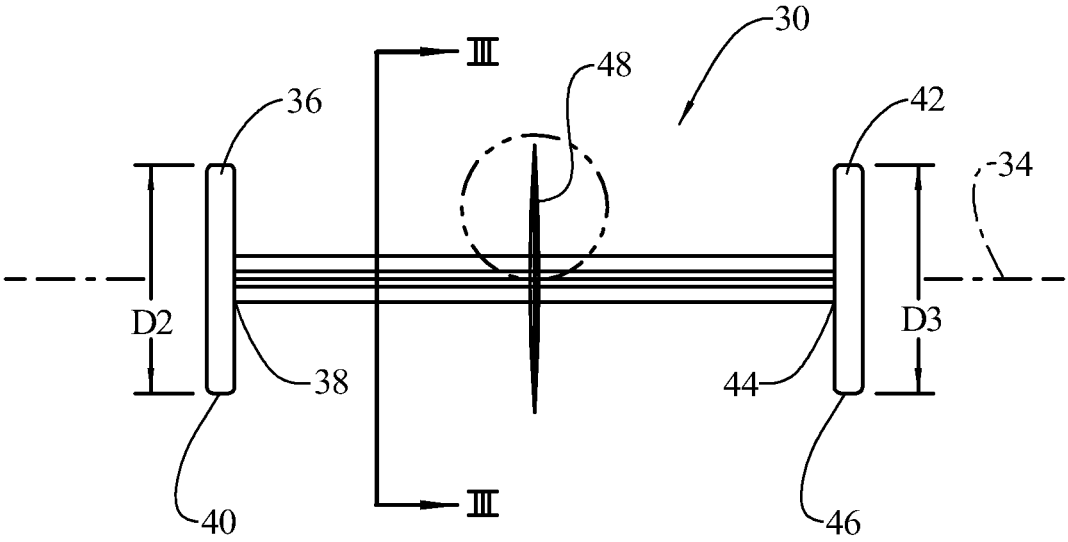
FIG. 2 is a side elevational view of the adapter of FIG. 1 shown in isolation.
Figure 3:
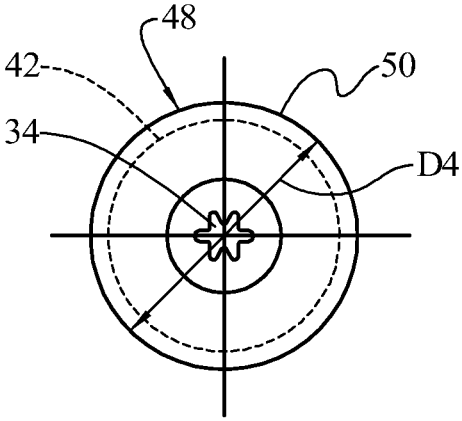
FIG. 3 is a lateral sectional view of the adapter of FIG. 2, taken generally along the line III-III in FIG. 2.

In FIG. 2, the adapter 30 is shown in isolation in a side elevational view. The adapter includes a post 32 extending longitudinally along an axis 34. A first platform 36, which may be in the shape of a circular disk, is positioned at a first end 38 of the post. The first platform 36 may have shapes other than circular, and, for example, may comprise a plurality of arms extending from the post 32 in at least two directions, such as in the form of spokes, particularly when the post is a single post located centrally. In other embodiments, there may be a plurality of posts 32 utilized with the first platform 36 extending between a first end 38 of each of the posts. The first platform 36 has at least one portion 40 extending laterally outwardly from the post 32 to occupy a distance slightly less than the predetermined diameter D1 of the fuel cell cavity 22. In the embodiment shown in FIGS. 2 and 3, the first platform 36 is a circular disk having a center point positioned at the axis 34 and with a diameter D2 which is slightly smaller than diameter D1 of the fuel cell cavity 22, so that the first platform may be loosely received in the fuel cell cavity, as explained below.

A second platform 42 is positioned at a second end 44 of the post 32. The second platform 42 may also be in the shape of a circular disk, or may have another shape, as described with respect to the first platform 36. The first 36 and second 42 platforms may have the same shape, or may have shapes different from each other. The second platform 42 has at least one portion 46 extending laterally outwardly from the post 32 to occupy a distance slightly less than the predetermined diameter D1 of the fuel cell cavity 22. In the embodiment shown in FIGS. 2 and 3, the second platform 42 is a circular disk having a center point positioned at the axis 34 and with a diameter D3 which is slightly smaller than diameter D1, of the fuel cell cavity 22 so that the second platform may be loosely received in the fuel cell cavity, as explained below.

Figure 4:
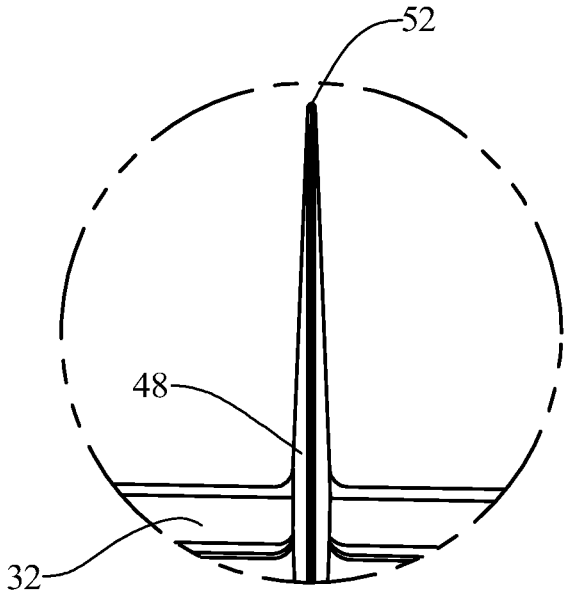
FIG. 4 is an enlarged partial side elevational view of the flange portion of the adapter of FIG. 1.

A flange 48 extends from the post 32 between the first 38 and second 44 ends of the post. The flange 48 may also be in the shape of a circular disk, or may have another shape, as described with respect to the first platform 36. The flange 48 does have at least one portion 50 extending laterally outwardly from the post 32 to occupy a distance, when combined with the post, slightly greater than the predetermined diameter D1 of the fuel cell cavity 22. In the embodiment shown in FIGS. 2 and 3, the flange 48 is a circular disk having a center point positioned at the axis 34 and with a diameter D4 which is slightly larger than diameter D1, of the fuel cell cavity 22 so that the flange will only be interferingly received in the fuel cell cavity, as explained below. The flange 48 is formed of a resilient material and has thickness (measured in the axial direction) so as to permit the flange to be deformed as the adapter 20 is inserted into the fuel cell cavity 22. In an embodiment, as shown in FIG. 4, the flange 48 may have a tapering thickness towards an outer periphery 52 of the circular disk. Such a tapered configuration will assist in the flexibility and resiliency of the flange 48.

Figure 5:
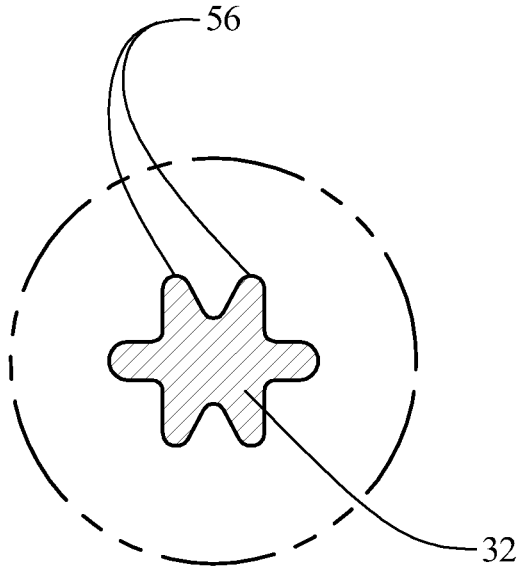
FIG. 5 is an enlarged lateral sectional view of the adapter post of FIG. 3.

In an embodiment, the adapter 20 may be a molded plastic material, such as polypropylene. As best seen in FIG. 5, to assist in the molding and cooling process, as well as to provide added strength to the post 32, while allowing for a reduced amount of material to be used for the post, the post may have a lateral cross section with a plurality of outwardly extending lobes 56. The 6 lobes shown in FIG. 5 allow for rapid and even cooling of the otherwise thick post structure, yet provide additional strength in the form of longitudinal beams.

In use, the adapter 30 may be inserted into the combustion tool fuel cell cavity 22 to occupy a portion of the height of the cavity. In a preferred embodiment, the flange 48 may be positioned equidistant from the first 36 and second 42 end platforms so that the adapter 30 may be inserted into the cavity 22 in either direction. The first end platform 36 will enter the cavity 22 in a loose fit manner, and will be able to easily slide into the cavity. When the flange 48 engages the walls of the cavity 22, the flange will bend slightly, assuring that the adapter 30 will be snuggly be held in the cavity. The adapter 30 will be able to be pushed further into the cavity 22 until the first end platform 36 engages a bottom wall of the cavity 22. When this occurs, the adapter 30 will be held in place by the flange 48 and will not inadvertently be dislodged from the cavity 22. A shorter fuel cell 24 can then be used in the fuel cell cavity 22, and it will be correctly positioned so that a fuel outlet from the fuel cell will be correctly positioned relative to the fuel cell dispensing outlet in the combustion tool.

In a particular combustion tool, the fuel cell cavity 22 has a predetermined dimension D1 of 1.360 inches (34.544 mm) and a length of 7.70 inches (195.580 mm). The end platforms 36, 42 may be circular with a diameter of 1.200 inches (30.480 mm) which will allow them to be loosely received in the fuel cell cavity 22. The flange 48 may be circular with a diameter of 1.400 inches (35.560 mm). This diameter is slightly larger than the internal dimension D1 of the fuel cell cavity 22, thereby allowing the flange 48 to hold the adapter within the cavity. A first (long) fuel cell has a can length of 6.600 inches (167.640 mm) and a second (short) fuel cell has a can length of 3.200 inches (81.280 mm). The axial dimensions of the post 32 and end platforms 36, 42 have a combined length of 3.400 inches (86.360 mm), precisely the difference between the can lengths of the two fuel cells. Thus, using the adapter 30 will precisely place the second (short) fuel cell in the correct location relative to the fuel cell dispensing outlet 28 in the combustion tool 20. In an embodiment, the end platforms 36, 42 can have an axial thickness of 0.125 inches (3.175 mm). The flange 48 may have an axial thickness of 0.051 inches (1.30 mm) where the flange joins the post 32, and may taper to an axial thickness of 0.010 inches (0.254 mm) at the circumference of the flange to allow for easy bending of the flange material when the adapter 30 is inserted into the fuel cell cavity 22.

While a particular embodiment of the present fuel cell adapter for a combustion tool has been described herein, it will be appreciated by those skilled in the art that changes and modifications may be made thereto without departing from the invention in its broader aspects and as set forth in the following claims.

The invention claimed is:

1. An adapter for a fuel cell, received in a fuel cell cavity of a combustion tool, the fuel cell cavity having a predetermined diameter, the adapter comprising:

a post extending longitudinally along an axis, a first platform positioned at a first end of the post and having at least one portion extending laterally outwardly from the post to occupy a distance slightly less than the predetermined diameter of the fuel cell cavity, a second platform positioned at a second end of the post and having at least one portion extending laterally outwardly from the post to occupy a distance slightly less than the predetermined diameter of the fuel cell cavity, a flange extending from the post between the first and second ends of the post and having at least one portion extending laterally outwardly from the post to occupy a distance, when combined with the post, slightly greater than the predetermined diameter of the fuel cell cavity, the flange being formed of a resilient material and a thickness so as to permit the flange to be deformed as the adapter is inserted into the fuel cell cavity.

2. The adapter according to claim 1, wherein the post is located along a central axis and the first and second platforms and the flange extend radially outwardly from the post in at least two radial directions.

3. The adapter according to claim 2, wherein the first and second platforms comprise circular disks, each with a center point centered at the axis of the post and having a diameter slightly smaller than the predetermined diameter of the fuel cell cavity.

4. The adapter according to claim 2, wherein the flange comprises a circular disk having a diameter slightly larger than the predetermined diameter of the fuel cell cavity.

5. The adapter according to claim 4, wherein the flange has a tapering thickness towards an outer periphery of the circular disk.

6. The adapter according to claim 1, wherein the post comprises a lateral cross section having a plurality of outwardly extending lobes.

7. The adapter according to claim 1, wherein the adapter is made of molded polypropylene.

8. An adapter for a fuel cell, received in a fuel cell cavity of a combustion tool, the fuel cell cavity having a predetermined diameter, the adapter comprising:

a central post extending along an axis, a first circular disk positioned at a first end of said central post with a center point of the first circular disk centered at the axis of the post and having a first diameter slightly smaller than the predetermined diameter of the fuel cell cavity, a second circular disk positioned at a second end of the central post with a center point of the second circular disk centered at the axis of the post and having a second diameter substantially identical to the first diameter of the first circular disk, a flange extending in at least two radial directions from the central post between the first and second ends of the central post and having a radial dimension slightly greater than the predetermined diameter of the fuel cell cavity, the flange being formed of a resilient material and a thickness so as to permit the flange to be deformed as the adapter is inserted into the fuel cell cavity.

9. The adapter according to claim 8, wherein the flange comprises a circular disk with a center point centered at the axis of the post.

10. The adapter according to claim 9, wherein the circular disk flange has a tapering thickness towards its outer periphery.

11. The adapter according to claim 8, wherein the post comprises a lateral cross section having outwardly extending lobes.

12. The adapter according to claim 8, wherein the adapter is made of molded polypropylene.

13. An adapter for a fuel cell, received in a fuel cell cavity of a combustion tool, the fuel cell cavity having a predetermined diameter, the adapter comprising:

a central post extending along an axis and comprising a lateral cross section having outwardly extending lobes, a first circular disk positioned at a first end of said central post with a center point of the first circular disk centered at the axis of the post and having a first diameter slightly smaller than the predetermined diameter of the fuel cell cavity, a second circular disk positioned at a second end of the central post with a center point of the second circular disk centered at the axis of the post and having a second diameter substantially identical to the first diameter of the first circular disk, a flange comprising a circular disk extending radially from the central post between the first and second ends of the central post and having a radial dimension slightly greater than the predetermined diameter of the fuel cell cavity, the flange being formed of a resilient material and a thickness so as to permit the flange to be deformed as the adapter is inserted into the fuel cell cavity, the flange having a tapering thickness towards its outer periphery.

14. The adapter according to claim 13, wherein the adapter is made of molded polypropylene.

* * * * *